US007202817B2

(12) United States Patent
Shinkai et al.

(10) Patent No.: US 7,202,817 B2
(45) Date of Patent: Apr. 10, 2007

(54) PATCH ANTENNA

(75) Inventors: Takayoshi Shinkai, Warabi (JP); Kenji Azumi, Warabi (JP)

(73) Assignee: Nippon Antena Kabushiki Kaisha, Tokyo (JP)

( * ) Notice: Subject to any disclaimer, the term of this patent is extended or adjusted under 35 U.S.C. 154(b) by 292 days.

(21) Appl. No.: 10/515,009

(22) PCT Filed: Mar. 10, 2004

(86) PCT No.: PCT/JP2004/003133

§ 371 (c)(1),
(2), (4) Date: Nov. 19, 2004

(87) PCT Pub. No.: WO2004/086562

PCT Pub. Date: Oct. 7, 2004

(65) Prior Publication Data

US 2006/0071856 A1 Apr. 6, 2006

(30) Foreign Application Priority Data

Mar. 26, 2003 (JP) ..... 2003-085516

(51) Int. Cl.
*H01Q 1/38* (2006.01)
*H01Q 1/48* (2006.01)

(52) U.S. Cl. ..... 343/700 MS; 343/846

(58) Field of Classification Search ..... 343/700 MS, 343/702, 846, 713
See application file for complete search history.

(56) References Cited

U.S. PATENT DOCUMENTS 6,181,279 B1 * 1/2001 Van Hoozen ..... 343/700 MS
6,549,166 B2 * 4/2003 Bhattacharyya et al. .... 343/700 MS

FOREIGN PATENT DOCUMENTS

| | | |
|---|---|---|
| EP | 1 291 970 A1 | 3/2003 |
| JP | 62-62446 | 4/1987 |
| JP | 09-167908 | 6/1992 |
| JP | 05-167345 | 7/1993 |
| JP | 06-41220 | 5/1994 |
| JP | 06-48210 | 6/1994 |
| JP | 07-147507 | 6/1995 |
| JP | 07-202555 | 8/1995 |
| JP | 04-69910 | 6/1997 |
| JP | 10-276019 | 10/1998 |
| JP | 2001-345629 | 12/2001 |
| JP | 2002-368513 | 12/2002 |
| JP | 2003-046323 | 2/2003 |
| JP | 2003-060425 | 2/2003 |

* cited by examiner

*Primary Examiner*—Shih-Chao Chen
(74) *Attorney, Agent, or Firm*—Kirk Hahn

(57) ABSTRACT

An object of the present invention is to provide a simple, reasonably-priced patch antenna which can be assembled easily. A pair of first L-shaped holding portions 14*b* formed on a spacer 14 is inserted into a pair of attachment holes 12*c* formed in an antenna plate 12, and the antenna plate 12 is slid so that the upper portions of the attachment holes 12*c* in the antenna plate 12 are gripped between the upper portions of the first L-shaped holding portions 14*b* and a spacer main body 14*a*. As a result, the antenna plate 12 is fixed to the spacer 14. Next, a pair of second L-shaped holding portions 14*e* is inserted into a pair of insertion holes 13*d* formed in a ground plate 13, and the ground plate 13 is slid so that the lower portions of the insertion holes 13*d* in the ground plate 13 are gripped between the upper portions of the second L-shaped holding portions 14*e* and the spacer main body 14*a*. As a result, the ground plate 13 is fixed to the spacer 14.

5 Claims, 14 Drawing Sheets

PATCH ANTENNA

This application is the U.S. National Phase under 35 U.S.C. §371 of International Application PCT/JP 2004/003133, filed on Mar. 10, 2004, which claims priority of Japanese Patent Application No. 2003-085516, which was filed on Mar. 26, 2003. The International Application was published under PCT Article 21(2) in a language other than English.

TECHNICAL FIELD

The present invention relates to a patch antenna capable of transmitting and receiving circularly polarized waves or linearly polarized waves.

BACKGROUND ART

A short range communication system called DSRC (Dedicated Short Range Communication) is known. DSRC is a wireless communication system for radio wave ranges of between several meters and several tens of meters used in ETC (Electronic Toll Collection Systems) and ITS (Intelligent Transport Systems). ETC is a system for paying tolls automatically which works by conducting communication between an antenna disposed on a tollgate and an in-vehicle device installed in a vehicle when an automobile passes through a toll booth on an expressway or the like. Using ETC eliminates the need to stop at toll booths, and hence the amount of time required for the automobile to pass through the tollgate is reduced greatly. As a result, traffic congestion in the vicinity of toll booths can be eased, and exhaust gas amounts can be reduced.

ITS is a transport system fusing a system for providing automobiles with intelligence such as a car navigation system, and a system for providing roads with intelligence such as a wide range traffic control system. Examples of a car navigation system include a system enabling collaboration with VICS (Vehicle Information and Communication Systems) When ITS is used in this way, information relating to minor roads gathered by the police and information relating to expressways gathered by the Metropolitan Expressway Public Corporation and the Japan Highway Public Corporation is edited and issued from the VICS center. Upon reception of this information, the car navigation system is able to search for a route which bypasses a traffic jam or the like, and display the route on its monitor.

Typically, a patch antenna is used as the antenna in DSRC and ETC. A constitutional example of a prior art patch antenna is shown in FIG. 21.

In the prior art patch antenna 100 shown in FIG. 21, an antenna substrate 103 is provided on a ground plate 101 via a spacer 102. A patch element 103*a* is formed on the antenna substrate 103 as a rectangular patch. Perturbation elements are formed at the apexes of the opposing angles of the patch element 103*a*, thus forming a circularly polarized wave antenna. The patch antenna is assembled by screwing screws into screw holes 106 provided in the four corners such that the ground plate 101, spacer 102, and antenna substrate 103 are integrated. A cable 104 for feeding the patch element 103*a* is led out from the rear surface of the antenna substrate 103, and a connector 105 is provided on the tip end thereof. The connector 105 is connected to a communication device having a reception function.

However, the required constitutional components of the patch antenna 100 shown in FIG. 21 are the ground plate 101, the spacer 102, the antenna substrate 103, double-sided tape to adhere the spacer 102 to the groundplate 101, and double-sided tape to adhere the antenna substrate 103 to the spacer 102. Furthermore, the patch antenna is assembled by screwing screws into the screw holes 106 provided in the four corners. The large number of required components and the complexity of assembly are problems. Moreover, the patch element 103*a* must be formed on the antenna substrate 103 by deposition or the like, and hence the construction of the antenna substrate 103 formed with the patch element 103*a* is both time-consuming and expensive.

It is therefore an object of the present invention to provide a patch antenna which is reasonably priced and easy to assemble.

DISCLOSURE OF THE INVENTION

To achieve this object, a patch antenna of the present invention is constituted by a planar antenna plate formed with a perturbation element, a planar ground plate disposed opposite the antenna plate with a predetermined gap therebetween, and a spacer having a predetermined permittivity disposed between the antenna plate and the ground plate. The antenna plate is formed with an attachment hole, and the ground plate is formed with an insertion hole. By having a first L-shaped holding portion, which is formed as a protrusion from one surface of the spacer, grip the periphery of the attachment hole, the antenna plate is fixed to the spacer, and by having a second L-shaped holding portion, which is formed as a protrusion from the other surface of the spacer, grip the periphery of the insertion hole, the ground plate is fixed to the spacer.

In the patch antenna of the present invention, a cable has a ground portion connected to the ground plate and a core wire for supplying electricity to the antenna plate. The core wire may be inserted into and held by an insertion hole of a holding piece formed integrally with the spacer.

Further, in the patch antenna of the present invention, the core wire of the cable fixed to the rear surface of the ground plate may be inserted into the insertion hole of the holding piece through an insertion hole formed in the ground plate, and an annular rib formed so as to protrude from the lower surface of the holding piece may be fitted into the insertion hole in the ground plate.

Further, in the patch antenna of the present invention, an assembly constituted by fixing together the antenna plate, spacer, and ground plate, each of which is formed with a through hole, may be stored in a storage space of a first case and a second case by fitting a protruding portion formed as a protrusion in the storage space of the first case through the through holes, and fitting the first case onto the second case, which comprises in the storage space thereof an annular protruding portion for receiving a tip end portion of the protruding portion.

Further, in the patch antenna of the present invention, the assembly may be aligned with the second case by fitting a bent piece, which is formed by bending an edge portion of the groundplate downward, into a fitting groove formed in the storage space of the second case.

According to the present invention, the patch antenna may be formed by having the first L-shaped holding portion, which is formed as a protrusion from one surface of the spacer, grip the periphery of the attachment hole formed in the antenna plate, and having the second L-shaped holding portion, which is formed as a protrusion from the other surface of the spacer, grip the periphery of the insertion hole formed in the ground plate. Thus the patch antenna can be assembled easily. Further, the antenna plate and ground plate can be formed by stamping metal plates made of brass or the like, and the spacer can be formed by molding a resin such as polyacetal, and hence the cost of the patch antenna can be reduced.

By inserting the annular rib formed so as to protrude from the lower surface of the holding piece into the insertion hole formed in the ground plate, the core wire of the cable can be prevented from contacting the ground plate even when heat generated during soldering of the core wire to the antenna plate melts the cable insulator.

Moreover, by fitting the protruding portion formed on the first case portion into the through hole formed in the patch antenna such that the first case portion is fitted onto the second case portion, the patch antenna can be aligned with and stored in the case. Here, the bent piece formed by bending the edge portions of the antenna plate downward is fitted into the fitting groove formed on the second case, and thus the patch antenna can also be aligned with the second case.

BEST MODE FOR CARRYING OUT THE INVENTION

Figure 1:
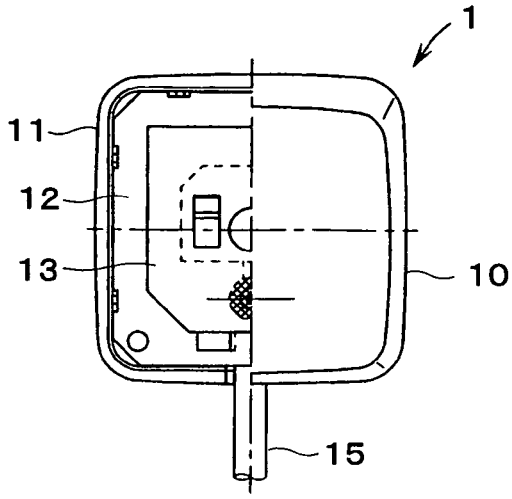
FIG. 1 is a plan view showing the constitution of a patch antenna according to an embodiment of the present invention as a half section.
Figure 2:
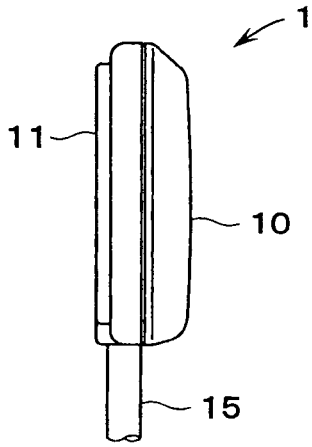
FIG. 2 is a left side view showing the constitution of the patch antenna according to an embodiment of the present invention.
Figure 3:
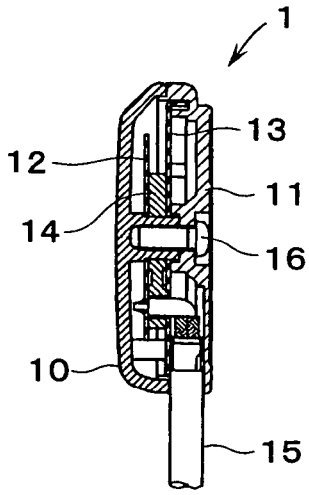
FIG. 3 is a right side view showing the constitution of the patch antenna according to an embodiment of the present invention in cross-section.

The constitution of a patch antenna according to an embodiment of the present invention is shown in FIGS. 1 through 3. Note that FIG. 1 is a plan view showing the constitution of the patch antenna as a half section, FIG. 2 is a left side view showing the constitution thereof, and FIG. 3 is a right side view showing the constitution thereof in cross-section.

A patch antenna 1 of the present invention shown in these drawings is capable of transmitting and receiving circularly polarized waves. The patch antenna 1 comprises an antenna plate 12 and a ground plate 13 created by processing metal plates made of brass or the like, and a spacer 14 made of a synthetic resin such as polyacetal, which is disposed between the antenna plate 12 and ground plate 13 so that the antenna plate 12 and ground plate 13 face each other with a predetermined gap therebetween.

The antenna plate 12 is fixed to the upper surface of the spacer 14, and the ground plate 13 is fixed to the lower surface of the spacer 14. Thus the antenna plate 12, spacer 14, and ground plate 13 are assembled as an integral unit. A cable 15 is connected to a predetermined feeding position on the antenna plate 12. The cable 15 is a coaxial cable having a braid wire serving as a ground portion soldered to the rear surface of the ground plate 13, and a core wire inserted through the ground plate 13 and spacer 14 and soldered to the antenna plate 12. The assembly constituted by the antenna plate 12, spacer 14, and ground plate 13 is aligned with and stored in a two-part case comprising an upper case 10 and a lower case 11 in a manner to be described below. The upper case 10 and lower case 11 are fixed together by a fixing screw 16.

Figure 4:
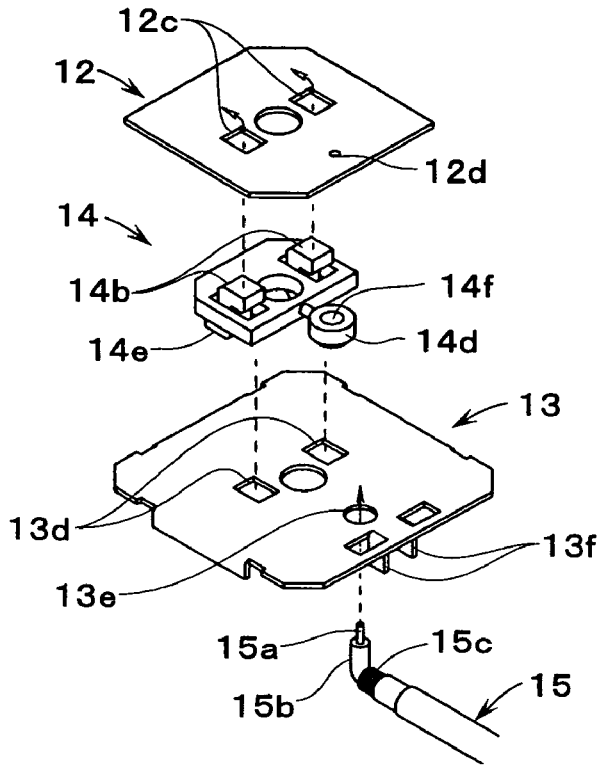
FIG. 4 is a view showing a process for assembling an assembly comprising an antenna plate, a spacer, and a ground plate according to an embodiment of the present invention.
Figure 5:
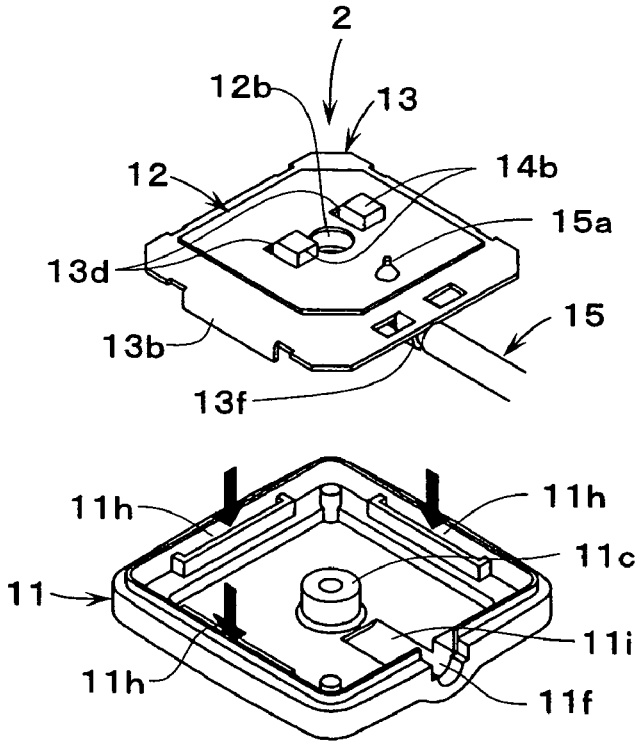
FIG. 5 is a view showing a process for aligning the assembly with a lower case and storing the assembly therein according to an embodiment of the present invention.
Figure 6:
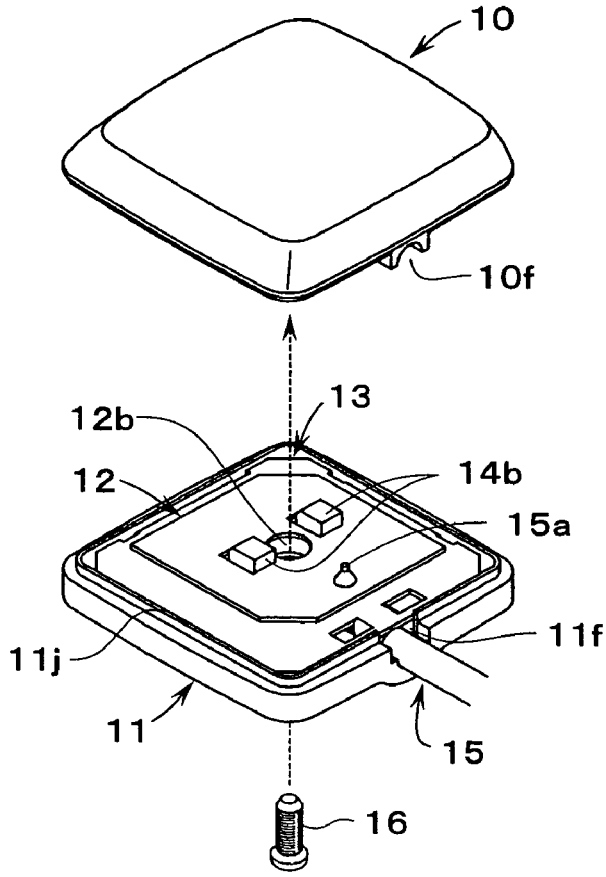
FIG. 6 is a view showing a process for aligning an upper case with the lower case storing the assembly and fitting the upper case onto the lower case according to an embodiment of the present invention.
Figure 7:
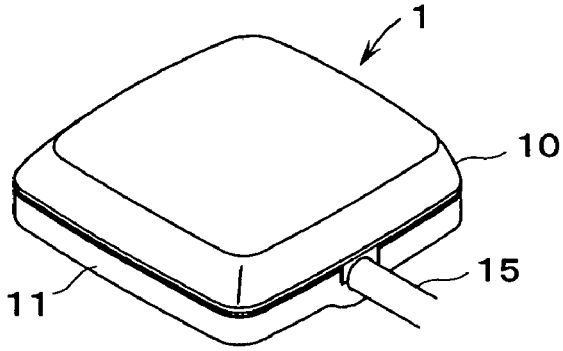
FIG. 7 is a perspective view showing the assembled patch antenna according to an embodiment of the present invention.

The assembly process of the patch antenna 1 according to this embodiment of the present invention is shown in FIGS. 4 through 7. Note that FIG. 4 shows the assembly process of the assembly constituted by the antenna plate 12, spacer 14, and ground plate 13, FIG. 5 shows a process for aligning the assembly with the lower case 11 and storing the assembly therein, FIG. 6 shows a process for aligning the upper case 10 with the lower case 11 storing the assembly and fitting the upper case 11 onto the lower case 11, and FIG. 7 shows the assembled patch antenna 1.

Figure 16A:
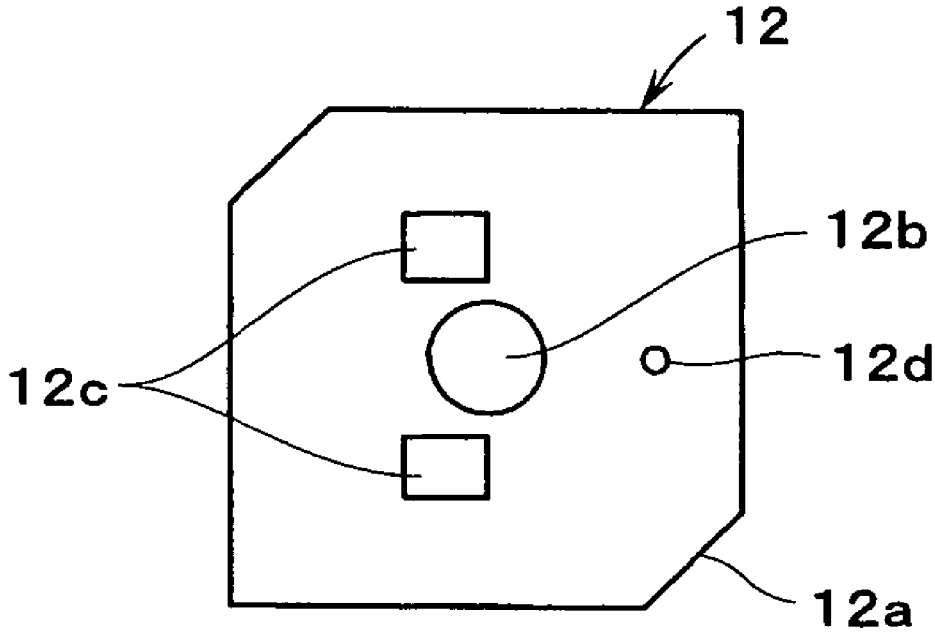
FIG. 16A is a front view showing the constitution of the antenna plate according to an embodiment of the present invention.
Figure 16B:
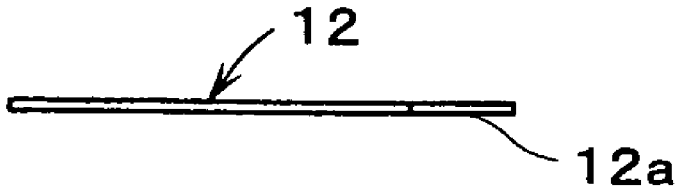
FIG. 16B is a side view showing the constitution of the antenna plate according to an embodiment of the present invention.

First, before describing the assembly process, the constitution of each component will be described in detail. The constitution of the antenna plate 12 is shown in detail in the front view of FIG. 16A and the side view of FIG. 16B. As shown in these drawings, the antenna plate 12 is formed by stamping a metal plate made of brass or the like, and has a pair of perturbation elements 12*a* formed in opposing corners to enable transmission and reception of circularly polarized waves. A circular through hole 12*b* is formed in the substantial center of the antenna plate 12, and a pair of rectangular attachment holes 12*c* is formed on both sides of the through hole 12*b*. First L-shaped holding portions 14*b* of the spacer 14, to be described below, are fitted through the attachment holes 12*c*. Further, a connection hole 12*d* to which the core wire of the cable 15 is connected by soldering is formed in a predetermined feeding position of the antenna plate 12.

Figure 17A:
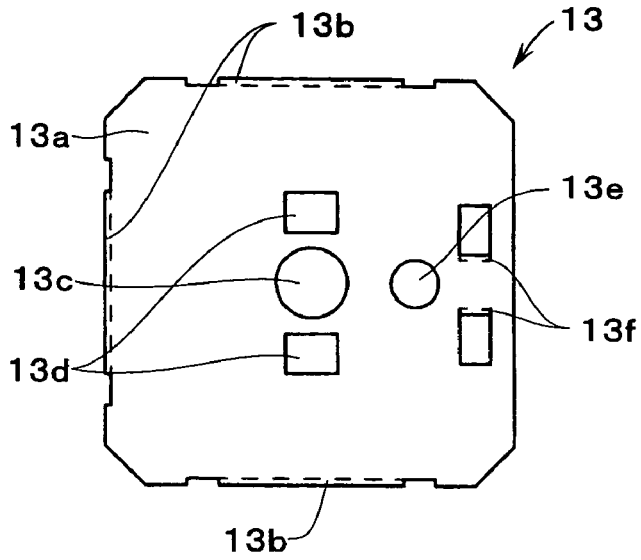
FIG. 17A is a front view showing the constitution of the groundplate according to an embodiment of the present invention.
Figure 17B:
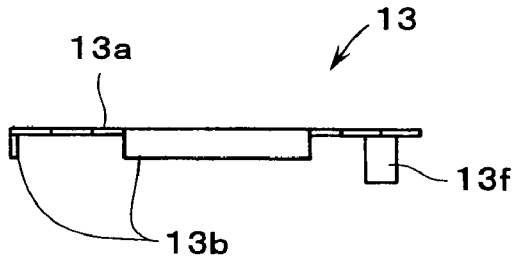
FIG. 17B is a bottom view showing the constitution of the ground plate according to an embodiment of the present invention.
Figure 17C:
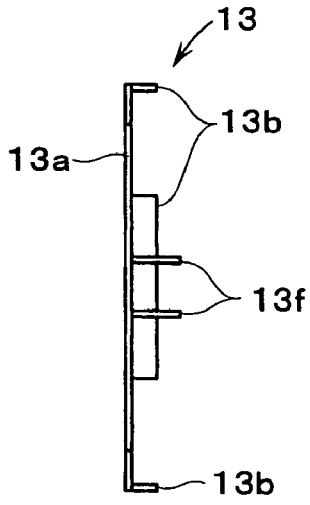
FIG. 17C is a side view showing the constitution of the ground plate according to an embodiment of the present invention.

The constitution of the ground plate 13 is shown in detail in FIGS. 17A, B, and C. Note that FIG. 17A is a front view showing the constitution of the ground plate 13, FIG. 17B is a bottom view showing the constitution thereof, and FIG. 17C is a side view showing the constitution thereof.

As shown in the drawings, the ground plate 13 comprises a ground plate main body 13*a* formed by stamping a metal plate made of brass or the like. Three sides of the ground plate main body 13*a* are bent downward to form elongated bent pieces 13*b*. A circular through hole 13*c* is formed in the substantial center of the ground plate main body 13*a*, and a pair of rectangular insertion holes 13*d* are formed on both sides of the through hole 13*c*. Second L-shaped holding portions 14*e* of the spacer 14, to be described below, are fitted through the insertion holes 13*d*. A further insertion hole 13*e* for inserting the insulated core wire of the cable 15 is formed in a position corresponding to the connection hole 12*d* in the feeding position of the antenna plate 12, and a pair of stamped rectangular binding pieces 13*f*, which are soldered to and bind the braid wire of the cable 15, are formed on the rear surface of the ground plate 13.

Figure 18A:
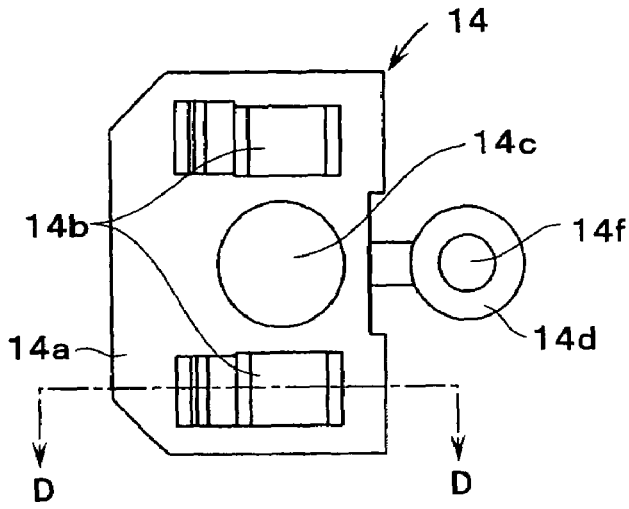
FIG. 18A is a front view showing the constitution of the spacer according to an embodiment of the present invention.
Figure 18B:
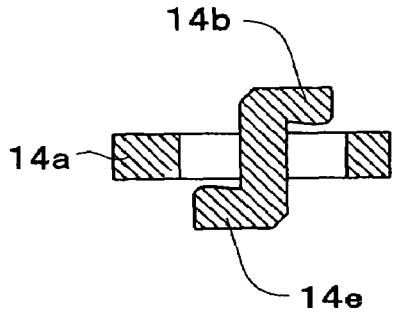
FIG. 18B is a sectional view severed along a D—D line showing the constitution of the spacer according to an embodiment of the present invention.
Figure 18C:
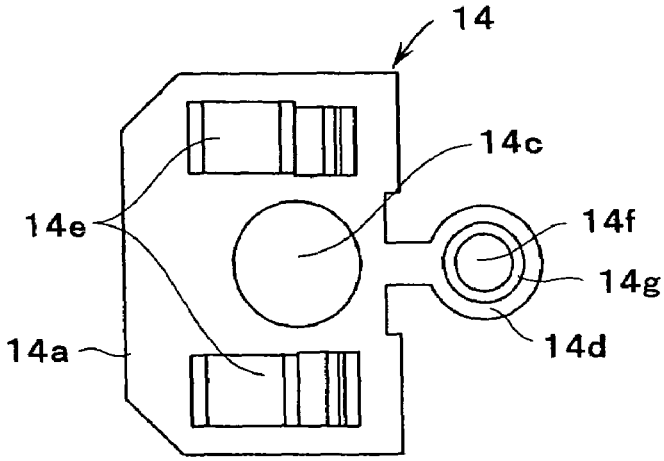
FIG. 18C is a rear view showing the constitution of the spacer according to an embodiment of the present invention.
Figure 19:
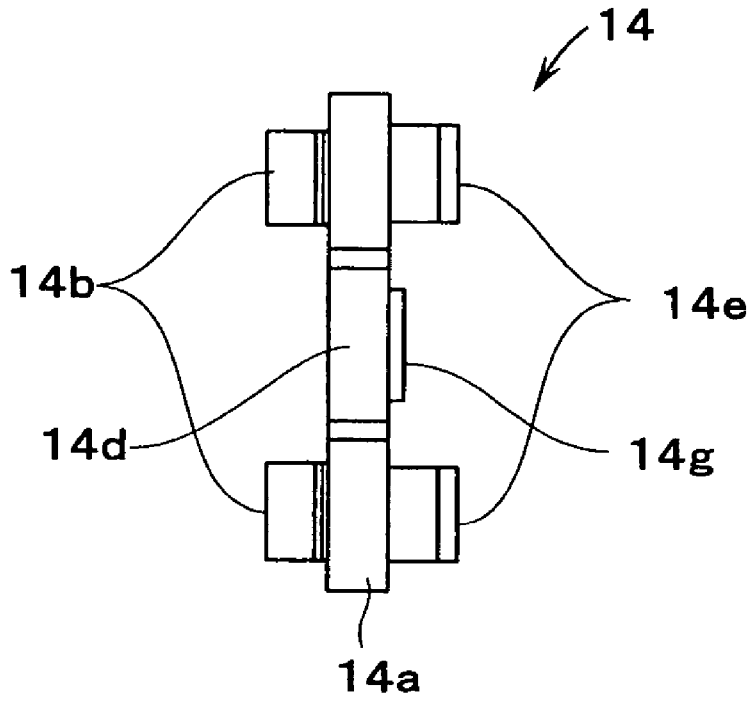
FIG. 19 is a side view showing the constitution of the spacer according to an embodiment of the present invention.
Figure 20:
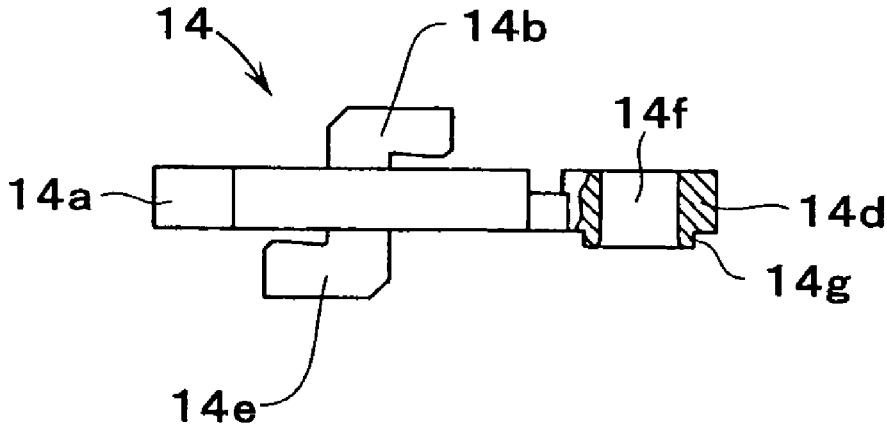
FIG. 20 is a bottom view showing the constitution of the spacer according to an embodiment of the present invention.
Figure 21:
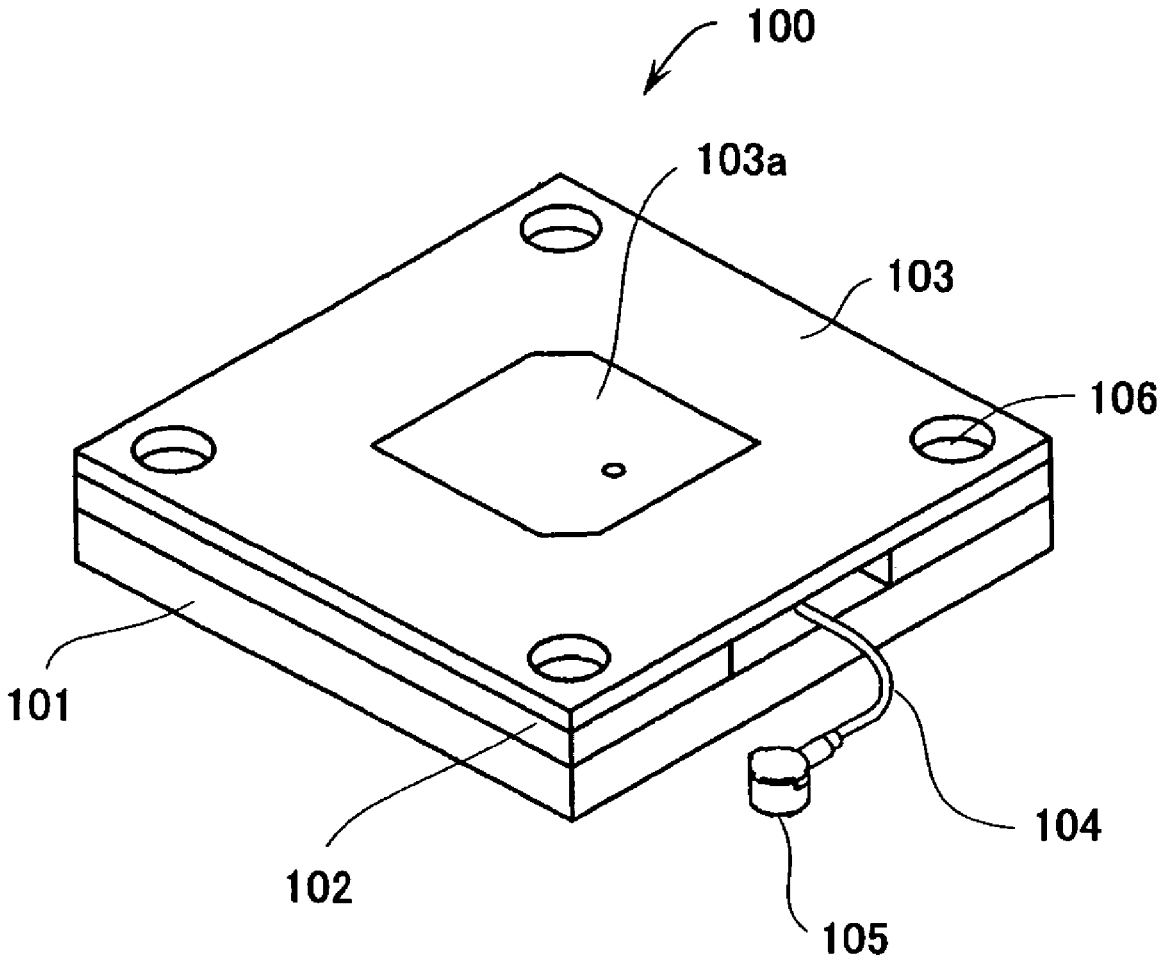
FIG. 21 Prior Art
FIG. 21 is a view showing a constitutional example of a prior art patch antenna.

The constitution of the spacer 14 is shown in detail in FIGS. 18 through 20. Note that FIG. 18A is a front view showing the constitution of the spacer 14, FIG. 18B is a sectional view severed along a D—D line showing the constitution thereof, FIG. 18C is a rear view showing the constitution thereof, FIG. 19 is a side view showing the constitution thereof, and FIG. 20 is a bottom view showing the constitution thereof.

As shown in the drawings, the spacer 14 is constituted by a spacer main body 14*a* and an annular feeder line holding piece 14*d* formed as an extension from the spacer main body 14*a*. A circular through hole 14*c* is formed in the substantial center of the spacer main body 14*a*, a pair of first L-shaped holding portions 14*b* are formed as protrusions from the upper surface of the spacer main body 14*a*, and a pair of second L-shaped holding portions 14*e* are formed as protrusions from the lower surface of the spacer main body 14*a*. The tip ends of the first L-shaped holding portions 14*b* and second L-shaped holding portions 14*e* are formed so as to face opposite directions to each other. Further, the upper portions of the first L-shaped holding portions 14*b* and second L-shaped holding portions 14*e*, which are substantially parallel to the spacer main body 14*a*, face the spacer main body 14*a* with a slight gap therebetween, the gap becoming gradually narrower toward the tip end. The antenna plate 12 or ground plate 13 is inserted into the gap between the upper portions of the first L-shaped holding portions 14*b* and second L-shaped holding portions 14*e* and the spacer main body 14*a*, and thus gripped thereby and held. Since the gap becomes gradually narrower toward the tip end, the antenna plate 12 and ground plate 13 can be fixed securely to the spacer 14 by the first L-shaped holding portions 14*b* and second L-shaped holding portions 14*e*.

The annular feeder line holding piece 14*d* extending from the spacer main body 14*a* is formed with an insertion hole 14*f* and an annular rib 14*g* which protrudes downward from the periphery of the insertion hole 14*f*. The core wire of the cable 15, wrapped in an insulator, is inserted into the insertion hole 14*f*, and the annular rib 14*g* is fitted into the insertion hole 13*e* formed in the ground plate 13. Note that the spacer 14 is created by molding a resin having a predetermined permittivity such as polyacetal.

Returning to FIG. 4, the process of assembling the assembly will be described with reference to FIG. 4. First, the pair of first L-shaped holding portions 14*b* formed on the spacer 14 as described above are inserted into the pair of attachment holes 12*c* formed in the antenna plate 12 such that the upper portions of the first L-shaped holding portions 14*b* protrude from the attachment holes 12*c*. The antenna plate 12 is then slid in a direction shown by the arrow in the drawing so that the peripheries of the attachment holes 12*c* are gripped between the upper portions of the protruding first L-shaped holding portions 14*b* and the spacer main body 14*a*. As a result, the upper portions of the attachment holes 12*c* in the antenna plate 12 are gripped between the upper portions of the first L-shaped holding portions 14*b* and the spacer main body 14*a* such that the antenna plate 12 is fixed to the spacer 14.

Next, with the antenna plate 12 fixed to the spacer 14, the pair of second L-shaped holding portions 14*e* are inserted into the pair of insertion holes 13*d* formed in the ground plate 13 such that the upper portions of the second L-shaped holding portions 14*e* protrude from the insertion holes 13*d*. The ground plate 13 is then slid downward so that the peripheries of the insertion holes 13*d* are gripped between the upper portions of the protruding second L-shaped holding portions 14*e* and the spacer main body 14*a*. As a result, the lower portions of the insertion holes 13*d* in the ground plate 13 are gripped between the upper portions of the second L-shaped holding portions 14*e* and the spacer main body 14*a* such that the ground plate 13 is fixed to the spacer 14. Further, the annular rib 14*g* formed on the feeder line holding piece 14*d* is fitted into the insertion hole 13*e*.

Thus the antenna plate 12 is fixed to the front surface of the spacer 14, and the ground plate 13 is fixed to the rear surface of the spacer 14. In this state, the cable 15 is disposed on the rear surface of the ground plate 13, and an insulator 15*b* covering the core wire 15*a* is inserted through the insertion hole 13*e* and then inserted through the insertion hole 14*f* in the feeder line holding piece 14*d* such that the core wire 15*a* protruding from the tip end of the insulator 15*b* is inserted into the connection hole 12*d* formed on the antenna plate 12. The core wire 15*a* inserted into the connection hole 12*d* is then soldered so that the core wire 15*a* is connected to the antenna plate 12. The braid wire 15*c* of the cable 15 is bound to the pair of binding pieces 13*f* by caulking, and then soldered. Thus the assembly is assembled, and the cable 15 leads out from the assembly.

Figure 8:
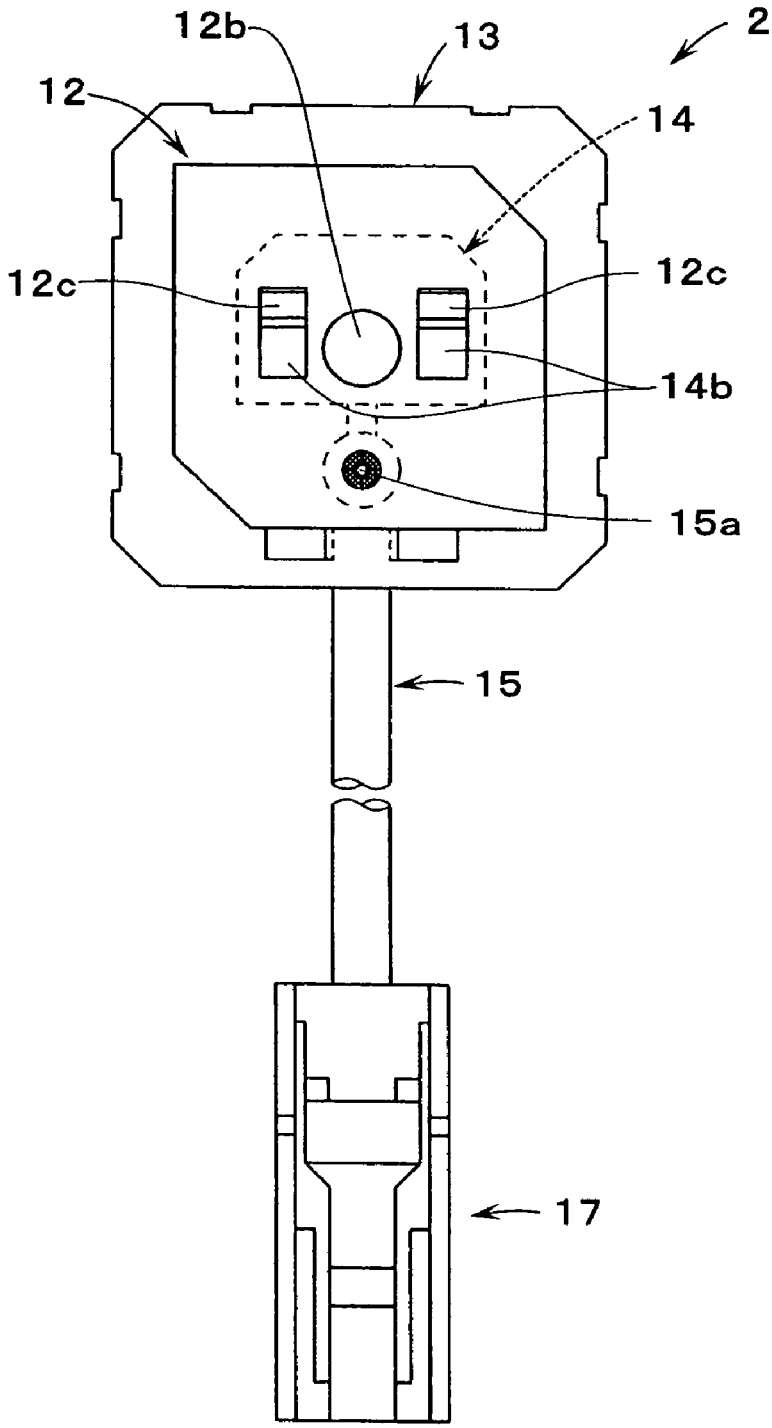
FIG. 8 is a front view showing the constitution of the assembly according to an embodiment of the present invention.
Figure 9:
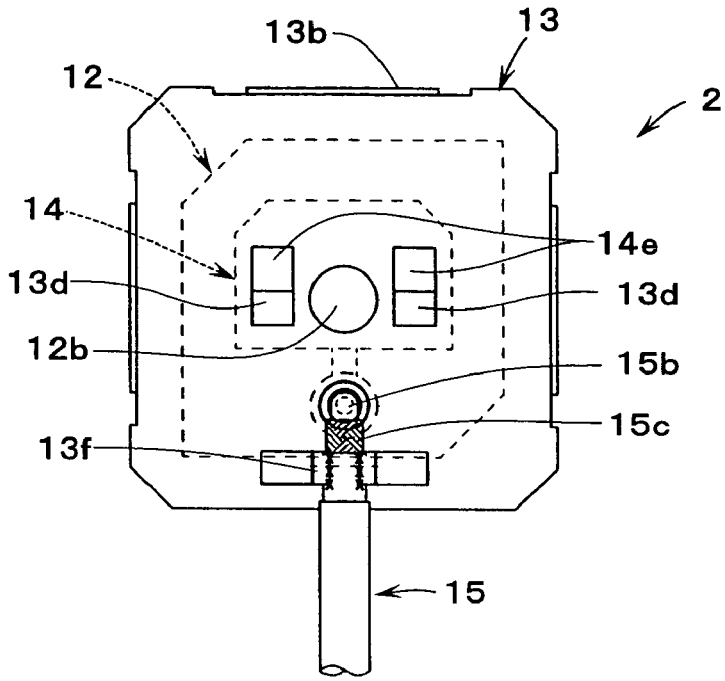
FIG. 9 is a back view showing the constitution of the assembly according to an embodiment of the present invention.
Figure 10:
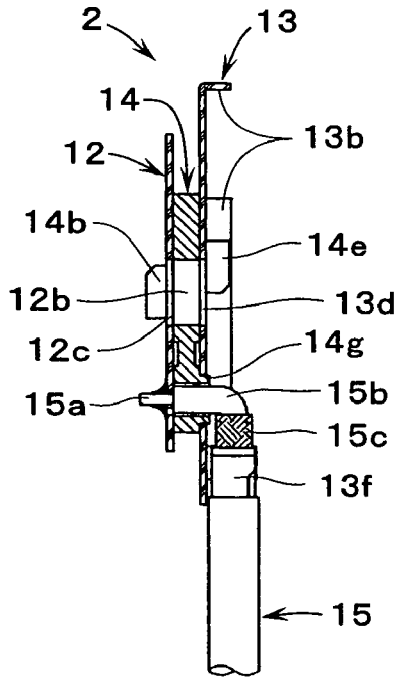
FIG. 10 is a side view showing the constitution of the assembly according to an embodiment of the present invention.

A front view of the constitution of the assembly 2 is shown in FIG. 8, a rear view showing the constitution thereof is shown in FIG. 9, and a side view showing the constitution thereof is shown in FIG. 10.

As shown in these drawings, a connection terminal 17 attached to a communication device is provided on the tip end of the cable 15 leading out from the assembly 2. Also, the positions of the through hole 12*b* formed in the antenna plate 12, the through hole 14*c* formed in the spacer 14, and the through hole 13*c* formed in the groundplate 13 are in substantial alignment within the assembly 2. Since the insulating annular rib 14*g* is fitted into the insertion hole 13*e* as shown in FIG. 10, the core wire 15*a* can be prevented from contacting the ground plate 13 by the action of the annular rib 14*g* even if the core wire 15*a* breaks through the insulator 15*b* when it becomes hot during soldering to the antenna plate 12. Note that by increasing the surface area of the spacer 14, it can be reduced in size, but since this causes a reduction in antenna gain, the surface area of the spacer 14 is set at approximately half the surface area of the antenna plate 12, and a high antenna gain is maintained while the relative permittivity $\epsilon s$ is reduced to approximately two.

This assembly 2 is stored in a case comprising the upper case 10 and lower case 11. The constitution of the upper case 10 and lower case 11 will now be described.

Figure 11A:
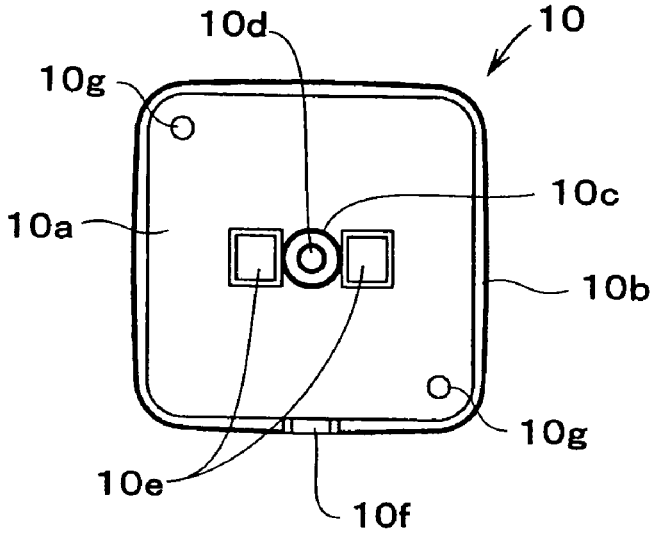
FIG. 11A is a plan view showing the constitution of the upper case according to an embodiment of the present invention.
Figure 11B:
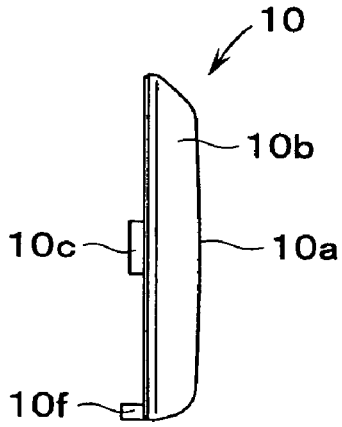
FIG. 11B is a side view showing the constitution of the upper case according to an embodiment of the present invention.
Figure 11C:
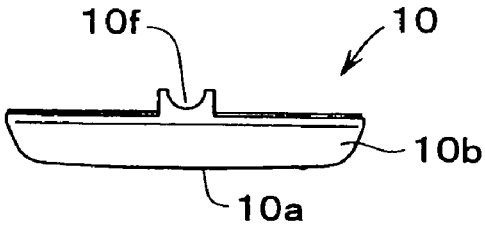
FIG. 11C is a bottom view showing the constitution of the upper case according to an embodiment of the present invention.
Figure 12:
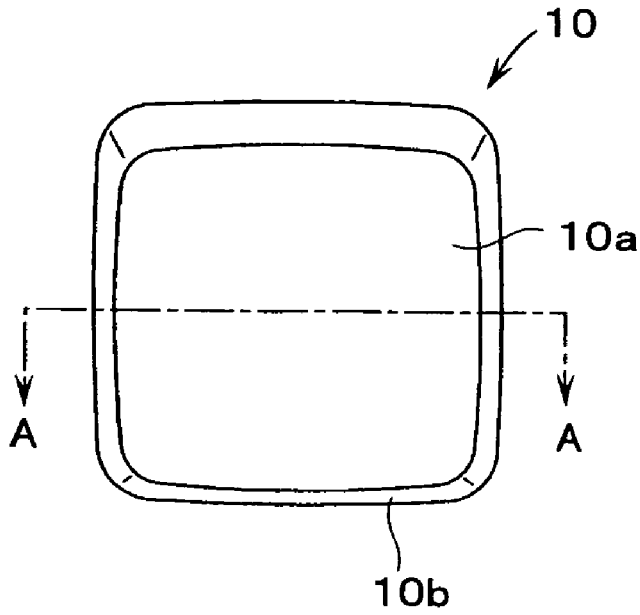
FIG. 12 is a front view showing the constitution of the upper case according to an embodiment of the present invention.
Figure 13:
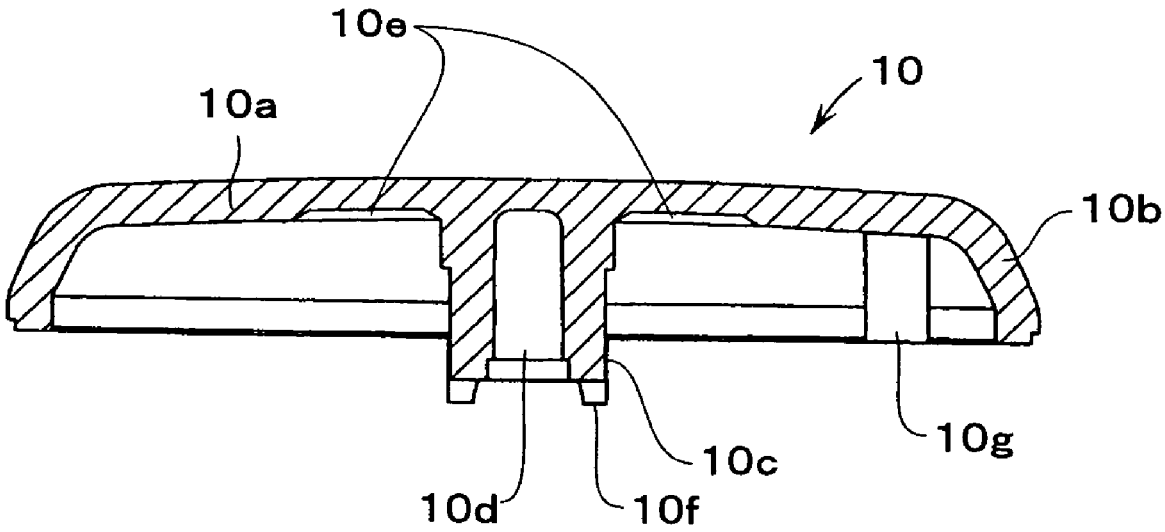
FIG. 13 is a sectional view severed along an A—A line showing the constitution of the upper case according to an embodiment of the present invention.

The constitution of the upper case 10 is shown in detail in FIGS. 11 through 13. Note that FIG. 11A is a plan view showing the constitution of the upper case 10, FIG. 11B is a side view showing the constitution thereof, FIG. 11C is a bottom view showing the constitution thereof, FIG. 12 is a front view showing the constitution thereof, and FIG. 13 is a sectional view severed along an A—A line showing the constitution thereof.

As shown in these drawings, a side wall portion 10*b* of a predetermined height is formed on the four sides of a rectangular upper case main body 10*a* of the upper case 10, and a storage space is formed in the interior thereof. A tubular protruding portion 10*c* that is longer than the side wall portion 10*b* is formed so as to stand in the substantial center of the storage space, and a pair of rectangular recessed portions 10*e* is formed on both sides thereof. Further, a pair of protrusions 10*g* having a small diameter are formed in opposing corners, and a cable holding portion 10*f* in the form of a semicircular groove, into which the cable 15 is introduced, is formed as a protrusion from one side of the side wall portion 10*b*.

A screw portion 10*d* is formed on the inner peripheral surface of the tubular protruding portion 10*c*. A fixing screw inserted through the lower case 11 is screwed into the screw portion 10*d* to integrate the upper case 10 and lower case 11. When storing the assembly 2 in the upper case 10, the assembly 2 is aligned with the upper case 10 by inserting the protruding portion 10*c* through the through hole 12*b*, through hole 14*c*, and through hole 13*c* in the assembly 2. The upper portions of the first L-shaped holding portions 14*b* protruding from the antenna plate 12 of the assembly 2 can be stored inside the recessed portions 10*e* formed on the inner surface of the upper case 10.

Figure 14A:
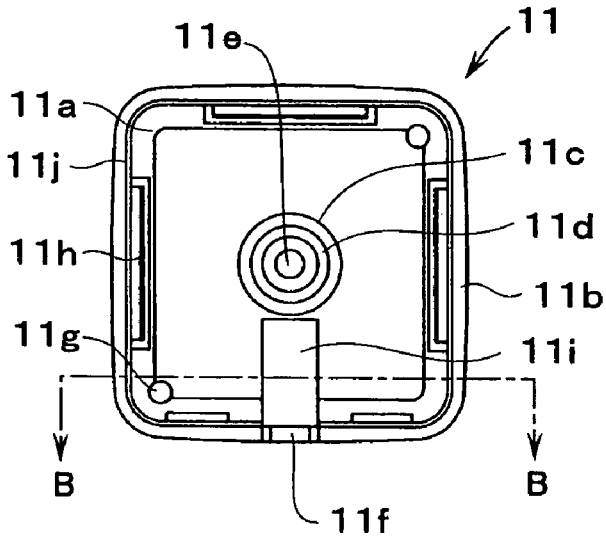
FIG. 14A is a plan view showing the constitution of the lower case according to an embodiment of the present invention.
Figure 14B:
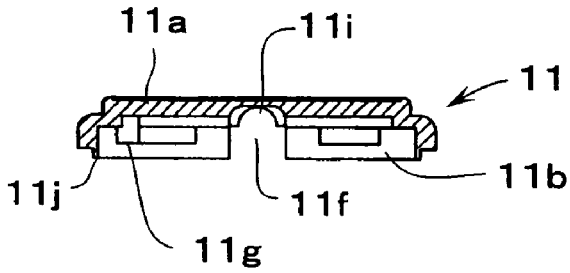
FIG. 14B is a sectional view severed along a B—B line showing the constitution of the lower case according to an embodiment of the present invention.
Figure 14C:
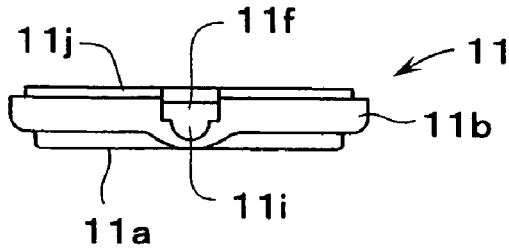
FIG. 14C is a bottom view showing the constitution of the lower case according to an embodiment of the present invention.
Figure 15A:
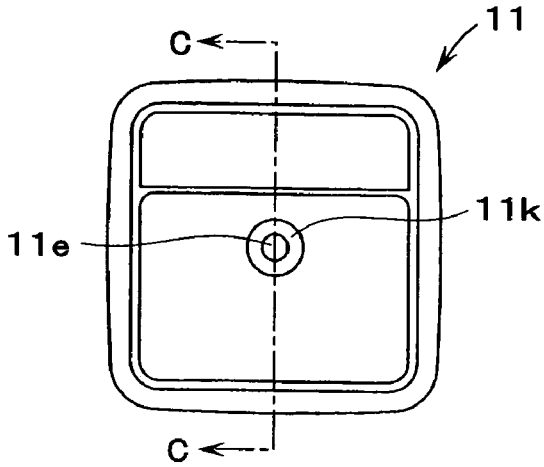
FIG. 15A is a front view showing the constitution of the lower case according to an embodiment of the present invention.
Figure 15B:
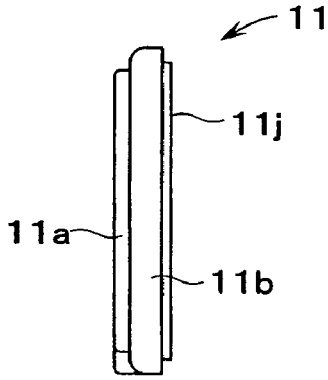
FIG. 15B is a side view showing the constitution of the lower case according to an embodiment of the present invention.
Figure 15C:
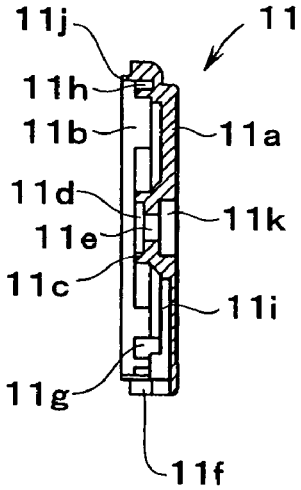
FIG. 15C is a sectional view severed along a C—C line showing the constitution of the lower case according to an embodiment of the present invention.

The constitution of the lower case 11 is shown in detail in FIGS. 14 and 15. Note that FIG. 14A is a plan view showing the constitution of the lower case 11, FIG. 14B is a sectional view severed along a B—B line showing the constitution thereof, FIG. 14C is a bottom view showing the constitution thereof, FIG. 15A is a front view showing the constitution thereof, FIG. 15B is a side view showing the constitution thereof, and FIG. 15C is a sectional view severed along a C—C line showing the constitution thereof.

As shown in the drawings, a side wall portion 11*b* of a predetermined height is formed on the four sides of a rectangular lower case main body 11*a* of the lower case 11, and a storage space is formed in the interior thereof. A short annular protruding portion 11*c* is formed in the substantial center of the storage space, and a cut-away portion 11*f*, the lower portion of which takes the form of a semicircular groove into which the cable 15 is introduced, is formed on one side of the side wall portion 11*b*. The cable holding portion 10*f* formed in the upper case 10 fits into a rectangular groove in the upper portion of the cut-away portion 11*f*. A cable holding groove 11*i* for accommodating the introduced cable 15 is formed from the cut-away portion 11*f* to the annular protruding portion 11*c*.

A pair of protrusions 11*g* having a small diameter is formed in opposing corners. These protrusions 11*g* are designed to abut against the protrusions 10*g* formed on the upper case 10 when the upper case 10 is fitted onto the lower case 11. Further, a through hole 11*e* is formed in the substantial center of the annular protruding portion 11*c*, and an annular groove portion 11*d* is formed on the tip end thereof. This annular groove portion 11*d* is designed to receive the tip end of the protruding portion 10*c* of the upper case 10 when the upper case 10 is fitted onto the lower case 11. An annular recessed portion 11*k* is formed in the rear surface of the lower case main body 11*a* so as to surround the through hole 11*e*. This annular recessed portion 11*k* serves to accommodate the head of the fixing screw that is inserted into the through hole 11*e*. Further, an annular protruding portion 11*j* is formed so as to protrude from the inner peripheral surface of the side wall portion 11*b* surrounding the lower case main body 11*a*. The annular protruding portion 11*j* is fitted into the inner peripheral surface of the side wall portion 10*b* of the upper case 10 when the upper case 10 is fitted onto the lower case 11. Elongated fitting grooves 11*h* are formed around three sides of the inside of the annular protruding portion 11*j*. When storing the assembly 2 in the lower case 11, the assembly 2 is aligned with the lower case 11 by fitting the bent pieces 13*b* formed on three sides of the ground plate 13 into these three fitting grooves 11*h*.

Next, the process for storing the assembly 2 in the case comprising the upper case 10 and lower case 11 will be described with reference to FIGS. 5 through 7.

As shown in FIG. 5, the assembly 2 is stored in the lower case 11 with the ground plate 13 of the assembly 2 on the bottom. At this time, the assembly 2 is aligned with and stored in the lower case 11 by fitting the bent pieces 13*b* formed on three sides of the ground plate 13 into the respective fitting grooves 11*h* as shown by the arrow. In so doing, the assembly 2 is aligned with the lower case 11. When storing the assembly 2 in the lower case 11, the cable 15 leading out from the assembly 2 is led outside through the cut-away portion 11*f*.

Next, the upper case 10 is fitted onto the lower case 11 storing the assembly 2 as shown in FIG. 6. At this time, the protruding portion 10*c* formed on the upper case 10 is inserted through the through hole 12*b*, through hole 14*c*, and through hole 13*c* in the assembly 2 such that the assembly 2 is aligned with the upper case 10. The annular protruding portion 11*j* of the lower case 11 is fitted into the inner peripheral surface of the side wall portion 10*b* of the upper case 10 such that the lower case 11 and upper case 10 are fitted together in alignment with each other. The tip end of the long protruding portion 10*c* formed on the upper case 10 is then inserted into the annular groove portion 11*d* of the annular protruding portion 11*c* formed on the lower case 11. In this state, the fixing screw 16 is inserted into the through hole 11*e* from the bottom of the lower case 11, as shown in the drawing, and then screwed into the screw portion 10*d* of the upper case 10. As a result, the upper case 10 and lower case 11 storing the assembly 2 are fixed together to form an integrated body, whereby the patch antenna 1 is assembled as shown in FIG. 7.

In the patch antenna 1 of the present invention described above, the antenna plate 12 is described as being rectangular, but the present invention is not limited thereto, and the antenna plate 12 may be circular. In this case, the antenna plate 12 may be constituted by a circular antenna element comprising perturbation elements to enable the transmission and reception of circularly polarized waves. Moreover, in the above description, the patch antenna 1 is designed to be capable of transmitting and receiving circularly polarized waves, but the present invention is not limited thereto, and the patch antenna 1 may be designed to be capable of transmitting and receiving linearly polarized waves by employing linearly polarized wave antenna elements as the antenna elements of the antenna plate 12.

INDUSTRIAL APPLICABILITY

In the present invention, as described above, a patch antenna may be formed by having first L-shaped holding portions formed as protrusions from one surface of a spacer grip the periphery of attachment holes formed in an antenna plate, and having second L-shaped holding portions formed as protrusions from the other surface of the spacer grip the periphery of insertion holes formed in a ground plate. Thus the patch antenna can be assembled easily. Further, the antenna plate and ground plate can be formed by stamping metal plates made of brass or the like, and the spacer can be formed by molding a resin such as polyacetal, and hence the cost of the patch antenna can be reduced.

By inserting an annular rib formed so as to protrude from the lower surface of a holding piece into an insertion hole formed in the ground plate, the core wire of a cable can be prevented from contacting the ground plate even when heat generated during soldering of the core wire to the antenna plate melts the cable insulator.

Moreover, by fitting a protruding portion formed on a first case portion into a through hole formed in the patch antenna such that the first case portion is fitted onto a second case portion, the patch antenna can be aligned with and stored in the case. Here, bent pieces formed by bending the edge portions of the antenna plate downward are fitted into fitting grooves formed on the second case, and thus the patch antenna can also be aligned with the second case.

The invention claimed is:

1. A patch antenna constituted by a planar antenna plate formed with a perturbation element, a planar ground plate disposed opposite said antenna plate with a predetermined gap therebetween, and a spacer having a predetermined permittivity disposed between said antenna plate and said ground plate, characterized in that said antenna plate is formed with an attachment hole and said ground plate is formed with an insertion hole such that by having a first L-shaped holding portion, which is formed as a protrusion from one surface of said spacer, grip the periphery of said attachment hole, said antenna plate is fixed to said spacer, and by having a second L-shaped holding portion, which is formed as a protrusion from the other surface of said spacer, grip the periphery of said insertion hole, said ground plate is fixed to said spacer.

2. The patch antenna according to claim 1, characterized in that a core wire of a cable having a ground portion connected to said ground plate, said core wire being used to supply electricity to said antenna plate, is inserted into and held by an insertion hole of a holding piece formed integrally with said spacer.

3. The patch antenna according to claim 2, characterized in that said core wire of said cable that is fixed to the rear surface of said ground plate is inserted into said insertion hole of said holding piece through an insertion hole formed in said ground plate, and an annular rib formed so as to protrude from the lower surface of said holding piece is fitted into said insertion hole in said ground plate.

4. The patch antenna according to claim 1, characterized in that an assembly constituted by fixing together said antenna plate, said spacer, and said ground plate, each of which is formed with a through hole, is stored in a storage space of a first case and a second case by fitting a protruding portion, which is formed as a protrusion in the storage space of said first case, through said through holes, and fitting said first case onto said second case, which comprises in the storage space thereof an annular protruding portion for receiving a tip end portion of said protruding portion.

5. The patch antenna according to claim 4, characterized in that said assembly is aligned with said second case by fitting a bent piece, which is formed by bending and fitting an edge portion of said ground plate downward, into a fitting groove formed in the storage space of said second case.

* * * * *